United States Patent [19]

Johnson

[11] 4,455,106

[45] Jun. 19, 1984

[54] FLASH GATE BOARD

[76] Inventor: William M. Johnson, P.O. Box 877, 2310 Langhorne Rd., Lynchburg, Va. 24505

[21] Appl. No.: 314,374

[22] Filed: Oct. 23, 1981

[51] Int. Cl.[3] ..... E02B 7/44

[52] U.S. Cl. ..... 405/94; 405/101

[58] Field of Search ..... 405/87, 94, 95, 99, 405/100, 101

[56] References Cited

U.S. PATENT DOCUMENTS

| | | | |
|---|---|---|---|
| 625,506 | 5/1899 | Hone . | |
| 1,084,454 | 1/1914 | Liljegran | 405/94 |
| 1,184,062 | 5/1916 | Bebout . | |
| 1,389,212 | 8/1921 | Parker . | |
| 1,438,913 | 12/1922 | Grillich | 405/94 |
| 1,938,675 | 12/1933 | Young . | |
| 2,051,359 | 8/1936 | Adams | 405/101 |
| 2,055,192 | 9/1936 | Becher | 405/101 |
| 3,543,521 | 12/1970 | Aubert | 405/94 |
| 4,073,147 | 2/1978 | Nomura | 405/94 |
| 4,349,296 | 9/1982 | Langeman | 405/94 X |

*Primary Examiner*—David H. Corbin

*Attorney, Agent, or Firm*—Kerkam, Stowell, Kondracki & Clarke

[57] ABSTRACT

A water control flash gate board uses a torsion spring to bias it in a upright water holding position. When the pressure on the upstream side of the gate board is sufficient to overcome the force of the torsion spring, the gate board will pivot towards a lower water releasing position. A resilient gasket is used along the lower end of the water gate board in order to prevent jamming of the board by debris. A plurality of identically constructed gate board assemblies may be arranged adjacent each other with lap gaskets positioned in between for preventing leakage.

6 Claims, 5 Drawing Figures

FLASH GATE BOARD

BACKGROUND OF THE INVENTION

The present invention relates to a water gate and, more particularly, a water gate adapted to automatically respond to the buildup of water pressure.

The use of water or flood gates is well known. Typically, such gates are built in at the top of a dam such that they may be opened to allow water above a certain level to escape and relieve pressure on the dam. Additionally, such water control gates may be used to allow logs, ice, or other floating debris to pass by a dam without damaging it.

Generally, such water control gates have either been operator controlled or automatically responsive. The operator controlled gates are those which move from a water holding position to a water releasing position in response to the control of a human operator, whereas the automatically responsive water control gates move from a water holding position to a water releasing position automatically in response to a predetermined water level and/or water pressure.

The operator controlled water gates are disadvantageous in that the requirement for a human operator adds greatly to the cost of operating the system. In addition, it is very difficult for a human operator to keep track of conditions along the length of a large dam. Of course, if the operator is to cause a water control gate to be opened so as to prevent a log or other floating debris from damaging the dam, he must be aware of floating debris at any point along the length of the dam.

To avoid the problems associated with operator controlled water gating systems, the prior art includes numerous automatically responsive water control gates. The following U.S. patents disclose such automatically responsive water control gating systems:

No. 625,506—Hone May 23, 1899
No. 1,184,062—Bebout May 23, 1916
No. 1,389,212—Parker Aug. 30, 1921
No. 1,938,675—Young Dec. 12, 1933
No. 4,073,137—Nomura Feb. 14, 1978

The Hone patent uses a lower sliding gate which is connected to an upper pivoting gate by way of a cable and pulley arrangement. When sufficient pressure is exerted on the upper gate, it will pivot to a water releasing position and in turn use the cable to lift the lower gate, thereby allowing water to escape adjacent the lower gate in addition to water escaping adjacent the upper gate.

The Bebout patent discloses a movable dam section which may be automatically operated when the water reaches a certain level. Specifically, when water enters bucket 27 (FIGS. 4 and 5) this causes the latch 19 to be moved, which in turn allows the movable dam section 1 to assume a water releasing position.

The Parker patent discloses a water control gating system useful for tide waters. In particular, Parker uses a coiled torsion spring (see especially FIG. 4) to allow tide water to return to the ocean.

The Young patent discloses a water control gate which pivots about axis 31 (FIG. 1) in response to water pressure overcoming weight 35 which tends to hold the gate 13 in a water retaining position. When the pressure exerted by the water diminishes sufficiently, the force exerted on gate 13 by weight 35 will cause the gate 13 to reassume an upright water holding position. The system disclosed in this patent includes a series of adjacent water controlling gates with a sealing strip 21 (FIG. 4) to prevent water leakage between adjacent gates.

The Nomura patent shows a hydraulic water gating control system including a helical spring which moves a gate between a water holding position and a water releasing position depending on the pressure on the gate.

Prior art automatically controlled water gating systems are subject to one or more of several disadvantages. Specifically, they have been prone to jamming as where a hinge, cable, or other movable part is subject to the water on the upstream (dam) side of the gate. Those gates which are designed to pass water over and under the gate are especially difficult in this regard in that a semi-submerged debris may jam on the under side of the gate. Also prior art water control gates are often subject to failure due to water induced corrosion of movable parts exposed to water on the upstream side of the gate.

Prior art water control gates using helical springs to bias the gate closed (in a water holding position) are disadvantageous in that material may be wedged in between the coils of the helical spring thereby disabling it. As a protective measure, the helical spring or springs may be shielded from possible jamming by debris, but this requires complex and difficult to manufacture structures.

SUMMARY OF THE INVENTION

Accordingly, it is a primary object of the present invention to provide a simple and effective water control gating system to relieve excess pressure behind a dam.

A further object of the present invention is to provide a water control gate or flash gate board which is designed to minimize the possibilities of damage to the structure caused by debris in the water.

A still further object of the present invention is to provide a flash gate board which may be used in conjunction with a series of substantially identical adjacent flash gate boards, each flash gate board being independently operable to relieve any localized pressure due to floating debris.

Yet another object of the present invention is to provide a water control gate automatically responsive to water pressure wherein the components which cause the gate to move from a water holding position to a water releasing position are not in direct contact with the water behind the dam.

The above and other objects of the present invention which will become apparent as the description proceeds are accomplished by an apparatus comprising a first gate assembly including a water retaining gate having an upstream side, a downstream side, an upper end, a lower end, and two side edges and which is pivotable between a water holding position and a water releasing position. The first gate assembly further includes a hinge secured to the water retaining gate to allow the water retaining gate to pivot between the water holding position and the water releasing position about a horizontal axis, and a torsion spring biasing the water retaining gate towards its water holding position. The water retaining gate automatically pivots in either direction between the water holding and the water releasing position depending upon the pressure from water or debris in the water on the upstream side of the water retaining gate, this pressure opposing the torsion spring and tending to move the water retaining gate to its water releasing position. Preferably, the horizontal axis about which the water retaining gate pivots is at the lower end of the water retaining gate. The torsion spring bears against the downstream side of the water retaining gate adjacent its lower end. In its more specific aspects, the first gate assembly further includes a horizontal hinge plate beneath the water retaining gate, the hinge being attached to the hinge plate and the downstream side of the water retaining gate adjacent its lower end. The hinge includes a hinge pin and the torsion spring is coaxial with the hinge pin, the hinge pin extending through coils in the torsion spring. The apparatus further includes additional gate assemblies including at least a second gate assembly and a third gate assembly both constructed identically to the first gate assembly. Each additional gate assembly is positioned adjacent one of the two side edges of an adjacent water retaining gate of an adjacent gate assembly with lap gaskets disposed between adjacent gate assemblies to prevent leakage.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DESCRIPTION OF THE PREFERRED EMBODIMENTS

Figure 1:
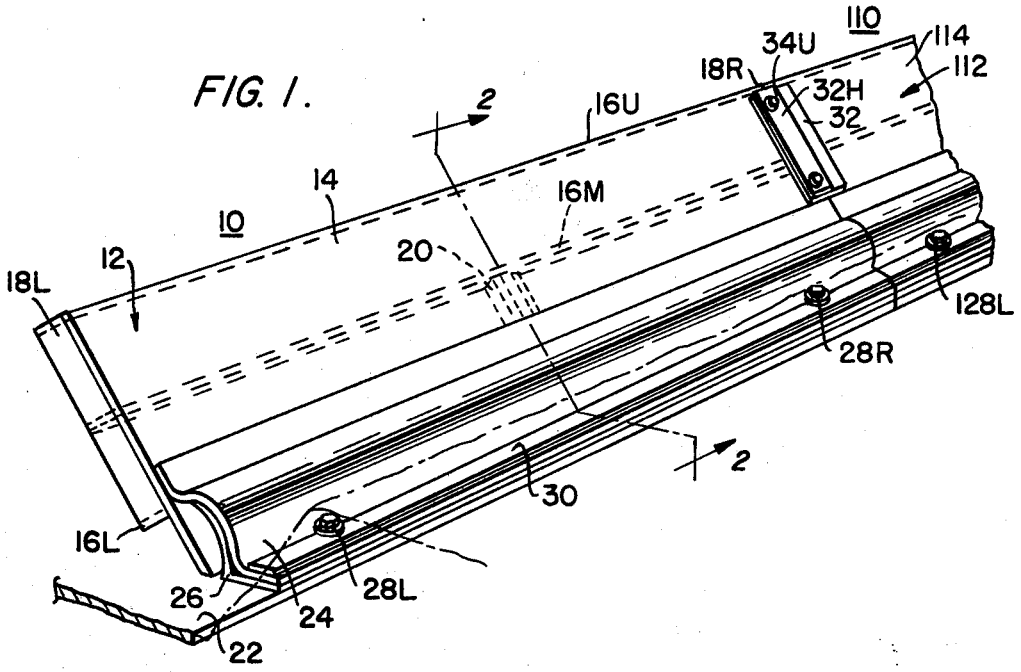
FIG. 1 shows a perspective view from upstream of a first gate assembly and part of a second gate assembly according to the present invention.

FIG. 1 shows a perspective view from upstream of a first gate assembly 10 and part of a second gate assembly 110 according to the present invention. As used herein, upstream will refer to that side of the gate having the dammed up water, whereas downstream will, of course, refer to the opposite side.

The first gate assembly 10 includes a water retaining gate 12 made of plate 14 having upper, middle, and lower horizontal ribs respectively labeled 16U, 16M, and 16L and right and left vertical struts respectively labeled 18R and 18L. Preferably, these are made of ductile iron due its ability to absorb shock and its relative flexibility and resistance to severe erosion. Additionally, if the water retaining gate 12 is made of ductile iron the casting of the unit may be accomplished by a commercial foundry without the need for machining or welding. The ribs 16U, 16M, and 16L and the struts 18R and 18L are preferably normal to the plane of plate 14 on its downstream side. A guide strut 20 shown in phantom line is disposed in between the side edges having vertically extending struts 18R and 18L. The function of the guide strut will be discussed in more detail in connection with the later drawings, it being sufficient to presently note that this strut provides a seat for a torsion spring (not shown in FIG. 1) which biases the water retaining gate 12 towards its water holding position, which is the position shown in FIG. 1.

The lower edge of plate 14 rests on a front bed plate 22. This front bedplate 22 also provides support to guard angle 26 and resilient gasket 24 which are secured by way of anchor plate 30 and bolts 28L and 28R. The front bedplate 22, guard angle 26, and anchor plate 30 are made of steel or ductile iron, whereas the resilient gasket 24 is preferably made of neoprene or a similar synthetic rubber.

A lap gasket 32 is secured at the right edge of plate 14 by upper and lower bolts 34U and 34L acting on holding plate 32J. The lap gasket 32 extends from the resilient gasket 24 to the top of plate 14 as shown.

As shown in FIG. 1, the first gate assembly 10 is essentially symmetric about its center line (corresponding to line 2—2) with the exception of the lap gasket 32. The second gate assembly 110 is identically constructed with a lap gasket (not shown) along its right side edge. A third gate assembly (not shown) identical to the other two may be located at the left of first gate assembly 10. And additional assemblies may be provided depending on the length of the dam.

Figures 2, 5:
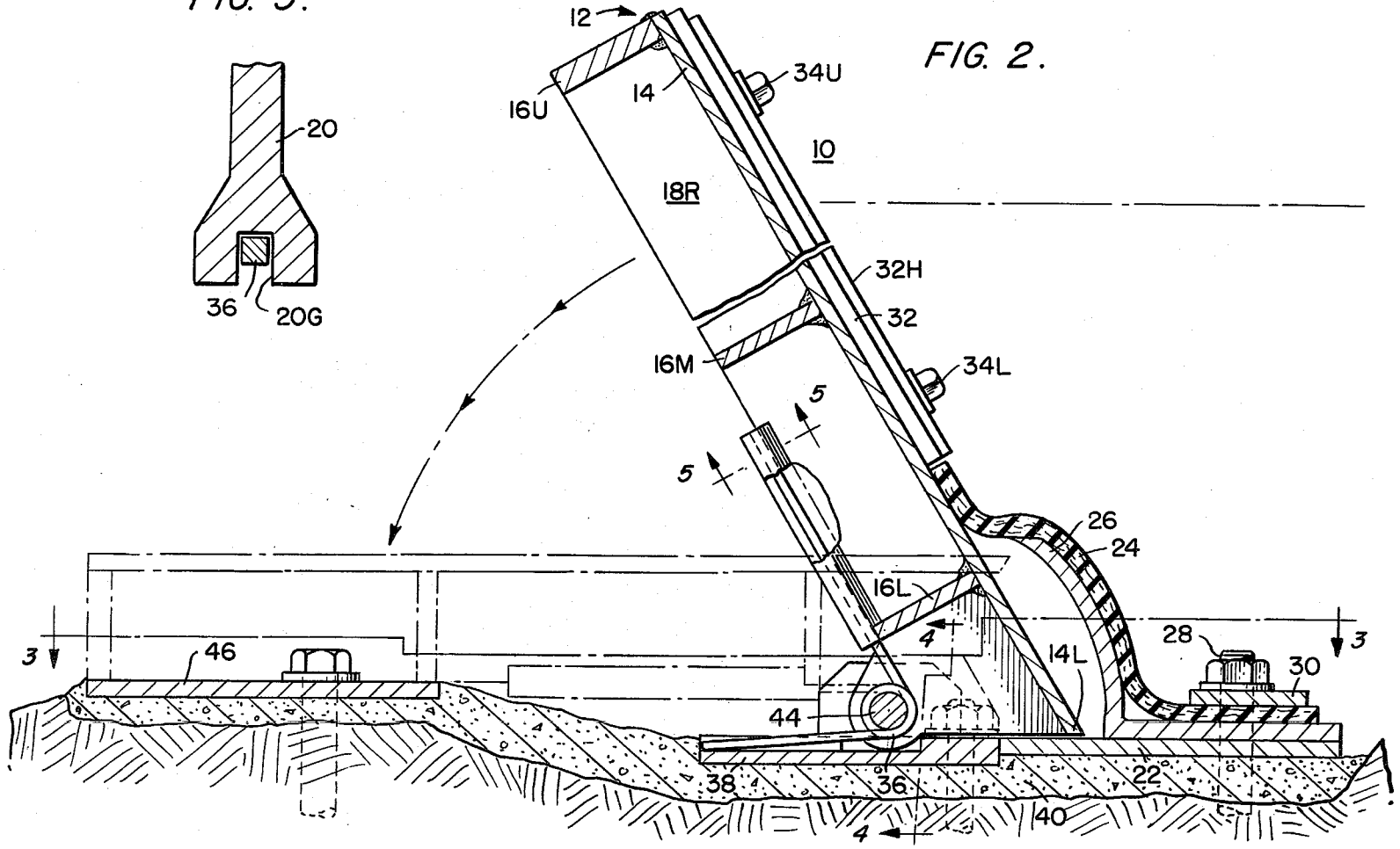
FIG. 2 shows a cross-sectional view along lines 2—2 of FIG. 1.
FIG. 5 shows a cross-sectional view along lines 5—5 of FIG. 2.

Turning now to FIG. 2, there is shown a cross-sectional view of the first gate assembly 10 as taken along lines 2—2 of FIG. 1. The water retaining gate 12 is shown in solid line in its water holding upright position and dashed line in its water releasing down position. A torsion spring 36 is used to bias the water retaining gate 12 towards its upright water holding position shown in solid line. The resilient gasket 24 is adapted to maintain contact with the upstream face of plate 14. Gasket 24 will thereby prevent any debris from jamming the gate by getting in between the lower edge 14L of plate 14 and the front bed plate 22.

Figure 4:
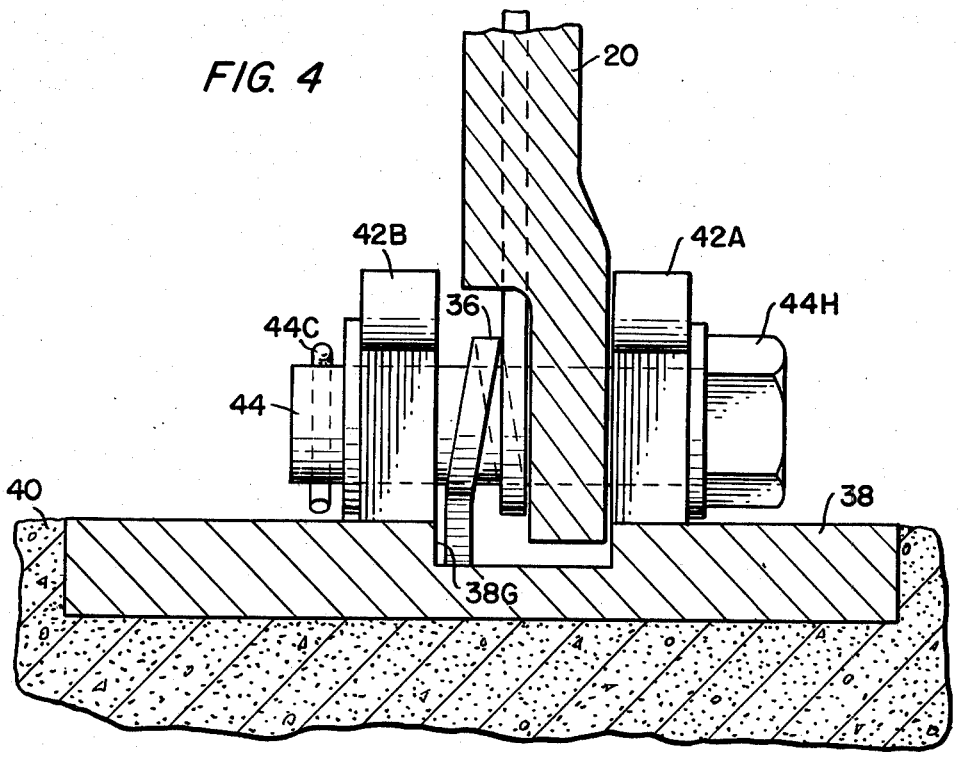
FIG. 4 shows a cross-sectional view along lines 4—4 of FIG. 2.
Figure 3:
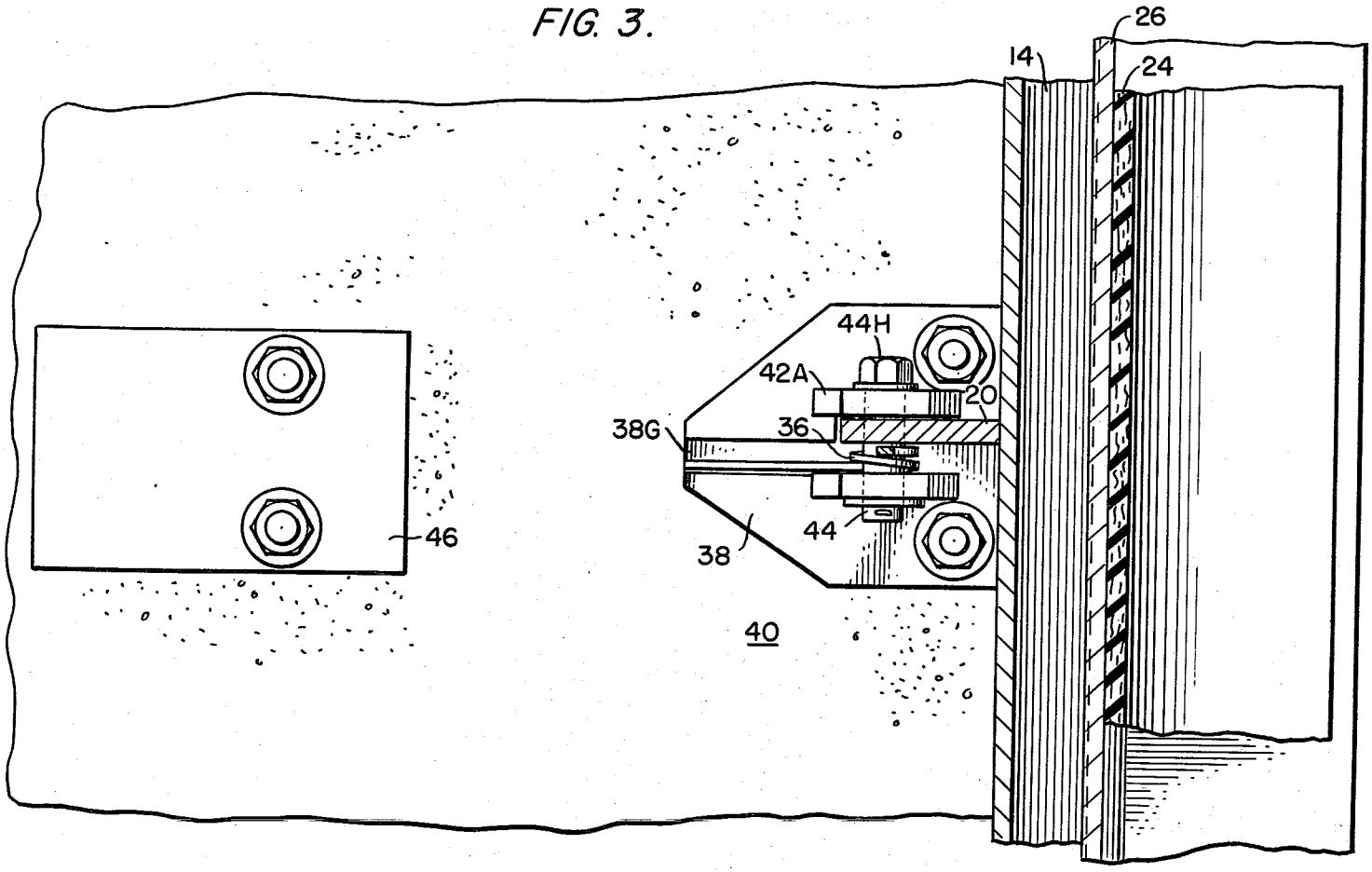
FIG. 3 shows a cross-sectional view along lines 3—3 of FIG. 2.

Continuing to view FIG. 2, but also considering FIG. 3 which is the view taken along lines 3—3 of FIG. 2, FIG. 4 which is the view taken along lines 4—4 of FIG. 2, and FIG. 5 which is the view taken along lines 5—5 of FIG. 2, the details of the operation of torsion spring 36 will presently be discussed. Mounted below the water retaining gate 12 and downstream from the front bed plate 22 is a ductile iron hinge plate 38 which is bolted into the grout bed 40. Extending out of hinge plate 38 are bearing posts 42A and 42B which rotably support the phosphor bronze or stainless steel hinge pin 44. The hinge pin 44 may be held in place by head 44H and cotter pin 44C.

The torsion spring 36 is coiled about hinge pin 44. Preferably, the torsion spring 36 is spring grade infinite cycle, non-corrosive bronze or other metal alloy of maximum unit strength for long life in spite of the constant vibration from wave action, moving water, and the impact of floating debris on the water retaining gate 12. The torsion spring 36 is seated within a groove 38G in the hinge plate 38. In addition, the other end of the torsion spring 36 will be seated within a groove 20G in the guide strut 20 which extends between the lower rib 16L and the middle rib 16M. A ductile iron bumper plate 46 may be bolted into the grout bed 40 so as to provide uniform bearing support for the water retaining gate 12 when the gate is in its water releasing position. As is best shown in FIG. 2, this bumper plate 46 may support the upper rib 16U and, if desired, the middle rib 16M.

With a view towards all of the drawings included herewith, the operation of the present invention will presently be outlined. Under normal operating conditions, the water retaining gate 12 of the present invention is maintained in its upright water holding position by the force of torsion spring 36. As is shown in FIG. 1 and FIG. 2, this upright position is preferably inclined in order to reduce the effect of the impact of floating debris and to facilitate the passing of such floating debris over the gate board and out of the reservoir. When the pressure of the water and/or debris on the upstream side of the water retaining gate 12 has reached a level sufficient to overcome the force of torsion spring 36, the water retaining gate 12 will pivot down to a water releasing position in phantom line in FIG. 2. The resilience of gasket 24 in addition to the water pressure exerted on the gasket 24 will cause it to slide down and maintain contact with the upstream side of plate 14. Once the water pressure or pressure of debris striking the gate has been sufficiently reduced, the torsion spring 36 will rotate the water retaining gate 12 back to its upright position. It should be readily appreciated that the gate board or water retaining gate 12 may stabilize in a position between the water holding position and the fully depressed water releasing position (shown in dotted line in FIG. 2) depending upon the balance between the torsion spring 36 and the pressure exerted on the gate 12 in addition to the weight of the gate 12.

In actual practice, it is highly desirable to include a number of gate assemblies adjacent to each other. The gate assemblies would be essentially identical to the first gate assembly 10 shown in FIG. 1 and would include lap gaskets 32 disposed between adjacent gate assemblies to prevent leakage. The lap gaskets would preferably be fixed on the side from which the prevailing current approaches the gate, thereby minimizing the possibility that debris would displace it. When a log or similar debris strikes one of the gate boards such as 12, the lap gasket 32 will fold to prevent any debris from wedging between the gate board edges when one gate board is depressed below the level of an adjacent gate board.

It will further be appreciated that when one gate board is depressed further than adjacent gate boards as when struck by a log or similar debris, the depression of that gate board will cause water to flow towards the depressed gate board, thereby facilitating the passage of the debris over the gate board 12.

Although the embodiment of FIG. 1 includes only a single torsion spring 36 and associated guide strut 20, a variable number of springs could be used depending upon the length of the gate 12. An alternate preferred embodiment of the present invention uses a middle strut similar to struts 18L and 18R and a guide strut 20 and associated torsion spring 36 disposed adjacent each of the two side edges of the gate 12.

Although specific structures and materials have been disclosed in the present specification, it is to be appreciated that these are for illustrative purposes only. Numerous modifications and adaptations will readily occur to those of ordinary skill in the art. Accordingly, the scope of the present invention should be determined by reference to the appended claims.

What is claimed is:

1. A flood control apparatus for mounting at the top of a dam, said apparatus comprising at least one gate assembly including:

a water retaining gate having an upstream side, a downstream side, an elongated upper edge, an elongated lower edge, and two side edges;

a hinge secured to the dam top and to said downstream side of said water retaining gate at the lower edge thereof to allow said water retaining gate to pivot about a horizontal axis between a water holding position and a water releasing position, said hinge including a hinge pin;

a torsion spring bearing against said downstream side of said water retaining gate to bias said water retaining gate towards said water holding position, said hinge pin being coaxial with and extending through coils of said torsion spring;

whereby said water retaining gate automatically pivots in either direction between said water holding position and said water releasing position in response to pressure from water or debris in the water on said upstream side of said water retaining gate sufficient to overcome the opposing pressure of said torsion spring and tending to move said water retaining gate to said water releasing position; and;

a resilient water sealing gasket in elongated strip form, said gasket being fixed at its lower edge to the dam top and free at its upper edge and disposed so as to press against said upstream side of said water retaining gate forming a wide contact seal surface therewith, and to yield and maintain contact with said upstream side of said water retaining gate when said water retaining gate is displaced from said water holding to said water releasing position, said resilient gasket thereby tending to prevent the jamming of said water retaining gate by keeping debris from said lower end of said water retaining gate.

2. A flood control apparatus for mounting at the top of a dam, said apparatus comprising at least one gate including:

a water retaining gate having an upstream side, a downstream side, an elongated upper edge, an elongated lower edge and two side edges;

a hinge secured to the dam top and to said downstream side of said water retaining gate at the lower edge thereof to allow said water retaining gate to pivot about a horizontal axis between a water holding position and a water releasing position, said hinge including a hinge pin;

a torsion spring bearing against said downstream side of said water retaining gate to bias said water retaining gate towards said hinge pin being coaxial with and extending through coils of said torsion spring;

whereby said water retaining gate automatically pivots in either direction between said water holding position and said water releasing position in response to pressure from water or debris in the water on said upstream side of said water retaining gate sufficient to overcome the opposing pressure of said torsion spring and tending to move said water retaining gate to said water releasing position;

a resilient sliding water sealing gasket in elongated strip form, said gasket being fixed at its lower edge to the dam top and at its upper edge and disposed so as to press against said upstream side of said water retaining gate forming a wide contact seal surface therewith, and to yield and maintain contact with said upstream side of said water retaining gate when said water retaining gate is displaced from said water holding to said water releasing position, said resilient gasket thereby tending to prevent the jamming of said water retaining gate by keeping debris from said lower end of said retaining gate;

a front bed plate beneath and upstream from said water retaining gate for mounting to the dam top; and a gasket support angle attached to said front bed plate and extending up immediately downstream of said elongated strip gasket in between the upstream side of said water retaining gate and a lower portion of said resilient gasket so as to provide support for said gasket.

3. The apparatus of claim 2 wherein said retaining gate is inclined from vertical when disposed in said water holding position, the inclination being such that said upper edge of said gate is downstream relative to said lower edge of said gate.

4. The apparatus of claim 2 wherein said water retaining gate comprises a planar gate board with a plurality of ribs running between said two side edges and a plurality of struts running between said upper edge and said lower edge, said ribs and struts being attached to said gate board on said downstream side.

5. The apparatus of claim 4 wherein said torsion spring is seated in a groove in one of said struts.

6. A flood control apparatus for mounting at the top of a dam, said apparatus comprising:

a plurality of essentially identical gate assemblies adjacent to each other, each of said gate assemblies including:

a water retaining gate having an upstream side, a downstream side, an elongated upper edge, an elongated lower edge, and two side edges;

a hinge secured to the dam top and to said downstream side of said water retaining gate at the lower edge thereof to allow said water retaining gate to pivot about a horizontal axis between a water holding position and a water releasing position, said hinge including a hinge pin;

a torsion spring bearing against said downstream side of said water retaining gate to bias said water retaining gate towards said water holding position, said hinge pin being coaxial with and extending through coils of said torsion spring;

whereby said water retaining gate automatically pivots in either direction between said water holding position and said water releasing position in response to pressure from water or debris in the water on said upstream side of said water retaining gate sufficient to overcome the opposing pressure of said torsion spring and tending to move said water retaining gate to said water releasing position;

resilient lap gaskets for preventing leakage between the respective side edges of adjacent gate assemblies, each of said lap gaskets being fixed in place on the upstream side of one of each pair of adjacent gates and being of sufficient width to maintain contact against the upstream side of the other of each pair of adjacent gates so as to be held thereagainst by water pressure while permitting independent movement of adjacent gates about their respective horizontal axes.

* * * * *